US006583101B1

(12) United States Patent
Wiseth et al.

(10) Patent No.: US 6,583,101 B1
(45) **Date of Patent: *Jun. 24, 2003**

(54) AQUEOUS ORGANIC DISPERSIONS SUITABLE FOR REMOVING ORGANIC FILMS AND SOILS

(75) Inventors: Wendy M. Wiseth, St. Paul, MN (US); Kim R. Smith, Woodbury, MN (US); Victor F. Man, St. Paul, MN (US); Scott I. De Fields, Woodbury, MN (US); Reid Rabon, So. St. Paul, MN (US); Mark D. Levitt, St. Paul, MN (US)

(73) Assignee: Ecolab Inc., St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/383,000

(22) Filed: Aug. 25, 1999

(51) Int. Cl.[7] ..... C11D 3/44

(52) U.S. Cl. ..... 510/407; 510/408; 510/365; 510/417; 510/418; 134/38

(58) Field of Search ..... 514/358, 642, 514/643; 510/365, 403, 404, 254, 246, 274, 421, 426, 432, 433, 407, 417, 418; 134/38

(56) References Cited

U.S. PATENT DOCUMENTS

| | | | | | |
|---|---|---|---|---|---|
| 4,592,787 | A | | 6/1986 | Johnson | 134/38 |
| 4,759,867 | A | * | 7/1988 | Choy et al. | |
| 4,808,235 | A | * | 2/1989 | Woodson et al. | |
| 4,859,359 | A | * | 8/1989 | DeMatteo et al. | |
| 4,992,108 | A | | 2/1991 | Ward et al. | 134/38 |
| 5,007,969 | A | | 4/1991 | Doscher | 134/38 |
| 5,080,822 | A | * | 1/1992 | VanEenam | |
| 5,080,831 | A | | 1/1992 | VanEenam | 252/558 |
| 5,096,610 | A | * | 3/1992 | Bingham | |
| 5,158,710 | A | | 10/1992 | VanEenam | 252/539 |
| 5,342,551 | A | * | 8/1994 | Ruckle | |
| 5,419,848 | A | | 5/1995 | VanEenam | 252/164 |
| 5,529,887 | A | | 6/1996 | Horn et al. | 430/331 |
| 5,585,341 | A | * | 12/1996 | VanEenam | |
| 5,849,682 | A | * | 12/1998 | VanEenam | |
| 5,908,854 | A | * | 6/1999 | McCue et al. | |
| 5,977,042 | A | * | 11/1999 | Hernandez et al. | |
| 6,221,823 | B1 | * | 4/2001 | Crisanti et al. | |

FOREIGN PATENT DOCUMENTS

| | | | |
|---|---|---|---|
| DE | 0743359 | * | 11/1996 |
| DE | 19723990 | * | 6/1997 |
| US | WO9715649 | * | 5/1997 |
| WO | WO 91/09104 | | 6/1991 |

OTHER PUBLICATIONS

*Handbook of Industrial Chemical Additives*, An International Guide by Product, Trade Name Function, and Supplier, Michael and Irene Ash, VCH Publishers, New York (1991), p. 146.

* cited by examiner

*Primary Examiner*—Gregory E. Webb
(74) *Attorney, Agent, or Firm*—Merchant & Gould P.C.

(57) ABSTRACT

Hard floor finishes and other stubborn soils can be removed using an aqueous dispersion of an alkylene glycol phenyl ether solvent combined with an ether alcohol solvent/coupler. Each component is used at a concentration that result in the creation of a visible dispersed appearance of the aqueous dilute use solutions. We have found that the alkylene glycol phenyl ether, in combination with at least one ether alcohol coupler or solvent, interacts with the aqueous medium to surprisingly provide enhanced cleaning performances. Hard to remove soils such as highly crosslinked urethanes and acrylic materials can be solubilized and removed by the alcohol solvent dispersions of the invention. We have found that the alkylene phenyl ether solvent requires a specific coupler cosolvent for activity. Such activity can be enhanced by the presence of a second coupler cosolvent and the use of a specific class of nonionic surfactant materials.

40 Claims, No Drawings

AQUEOUS ORGANIC DISPERSIONS SUITABLE FOR REMOVING ORGANIC FILMS AND SOILS

FIELD OF THE INVENTION

The invention relates to organic concentrates that can be diluted to form aqueous organic dispersions useful in removing polymeric films and organic soils. More particularly, the invention relates to the use of certain solvent blends for forming aqueous dispersions of water-activated materials. These dispersions are useful for removing soils and films from a variety of common substrates including fabrics, porous surfaces and hard surfaces. Further, the aqueous diluted composition can be used to remove organic soils or polymeric films from woven and non-woven fabrics and from hard surfaces such as metal surfaces, floor surfaces, wood surfaces, vinyl surfaces, etc. The aqueous organic materials of the invention are surprisingly effective in removing stubborn crosslinked resistant films or organic layers from a variety of substrates. The aqueous organic materials can be manufactured in the form of a non-aqueous concentrate and used as an aqueous dispersion after dilution.

BACKGROUND OF THE INVENTION

The removal of polymeric films and organic soils from a variety of substrates has been a goal of many investigators for many years. In large part, such investigations have focused on films or soils that are formed on fabric materials such as woven and non-woven fabrics and on hard surfaces such as metal, wood, concrete, vinyl, composite, etc. These polymeric films typically include natural products such as protein and cellulosics, synthetic polymers such as linear or crosslinked acrylics, urethanes, etc. Fabrics and hard surfaces, both porous and nonporous, can be covered with materials intentionally or unintentionally contacted or applied to the locus. Intentionally applied materials include floor finishes, paints, lacquers, adhesives, graffiti, oxidized or polymerized food soils, photoresist, etc. Such materials are generally organic polymeric materials that can also be crosslinked using isocyanate, aziridine, air-oxidation, silane or epoxy chemistries. Woven and non-woven fabrics can be soiled in food processing. Fabrics can be soiled in industrial chemical processing such as in the use of photoresists (exposed and unexposed) in making printed circuit boards or integrated circuits. In large part, one important aspect of the invention is focused on the removal of such crosslinked and non-crosslinked polymeric materials from a variety of substrates in a variety of processes such as hard surface cleaning, floor stripping, laundry, etc.

Stripping compositions for removing paint, lacquer, floor finish, alkyd paints are also well known. Common strippers are commonly either aqueous alkaline solutions, aromatic hydrocarbon liquids such as xylene blends, methylene chloride ($CH_2Cl_2$) or aqueous $CH_2Cl_2$ dispersions, dispersions of fluorocarbon surfactants and a variety of other materials. These strippers are useful, but can pose operating and environmental unpleasantness, inconvenience or hazard.

Laundry cleaners are commonly manufactured by combining organic and inorganic materials to form formulations comprising detergents, builders, defoamers and a variety of other ingredients that typically modify the surface energy in the soil to promote soil release and cleaning properties. These compositions tend to be primarily directed to changing the nature of the interface environment between the soil and the fabric. Specialty laundry strippers, solvents and other systems are known in unique cleaning systems.

We have found, for example, Johnson, U.S. Pat. No. 4,592,787, which teaches a polymer stripper used in aqueous form comprising an inorganic basic material, an alkanol amine, a lower alkanol and a propylene glycol ether. Ward et al., U.S. Pat. No. 4,992,108, teach an organic polymer stripper composition comprising an aromatic hydrocarbon and an organic sulfonic acid material. The Ward et al. materials are non-aqueous strippers. Doscher, U.S. Pat. No. 5,007,969, discloses a liquid solvent comprising a low toxicity, low vapor pressure solvent based on organic carbonate compositions. Horn et al., U.S. Pat. No. 5,529,887, disclose a polymeric stripper composition based on fluorine chemistry containing an inorganic base, a water soluble fluoride composition and organic solvents. Van Eenam, U.S. Pat. Nos. 5,080,831 and 5,158,710, disclose aqueous degreaser compositions comprising a variety of organic solvents, surfactants, inorganic bases and other components. The Van Eenam materials are formulated in clear aqueous composition requiring a surfactant material that balances the nature of the solvents in the aqueous composition and also requires the presence of an inorganic base, sequestrant and inorganic builder material to enhance cleaning degreasing efficacy. Appropriate balance of materials in the Van Eenam system is indicated by a clear solution or a clear, transparent microemulsion in the presence of water. Van Eenam, U.S. Pat. No. 5,158,710, exemplifies cleaner/degreaser materials containing 1-phenoxy-2-propanol, an alcohol amine base, a silicate base and an anionic sulfonate surfactant material. These materials in admixture are critical to achieve the cleaning results required by Van Eenam. Van Eenam, WO 91/09104, published Jun. 27, 1991, exemplifies a cleaner/degreaser comprising 1-phenoxy-2-propanol combined with a fatty diethanol amide surfactant material optionally combined with a monoethanolamine aqueous base. Van Eenam also discloses the use of acrylic and other thickeners and materials that enhance viscosity and cleaning. Van Eenam, U.S. Pat. No. 5,419,848, teaches stable compositions comprising a sparingly soluble organic solvent, a thickener typically comprising a clay or a polymeric material, and an organic or inorganic base. Further, Van Eenam, U.S. Pat. No. 5,585,341, discloses similar compositions to the previous Van Eenam patent except that these materials are described as substantially non-aqueous, contain much less than 10 wt % water and include a solubilizing anionic or nonionic surfactant component such as an alkyl benzene sulfonic acid, an alcohol ethoxylate surfactant, an aliphatic phosphate ester, etc. The Van Eenam patents typically set the use level of the compositions of the invention at or below the solubility of the compositions ingredients in the aqueous media used in the Van Eenam disclosure.

Conventional concentrated, water-soluble dilutable cleaner/degreaser compositions typically comprise substantially water soluble organic solvents such as ethylene glycol monobutylether, diethylene glycol monobutylether, ethyl diethylene glycol monoethylether, other related cellosolves or carbitols, isopropyl alcohol in combination with anionic nonionic surfactants and conventional adjuvants such as chelants, builders, perfumes, dyes, pH, modifiers, etc. Typically such materials require in the following formulation motif, a builder, a base, an adjuvant such as a chelator or thickener, etc. for activity:

TABLE 1

Conventional Cleaner/Degreaser Formula

| Ingredient | Wt % |
|---|---|
| Water-soluble solvent | 2–10 |
| Inorganic Builder | 10–25 |
| Organic or Inorganic Base | 0.1–10 |
| Thickener | 0–5 |
| Surfactant (anionic/nonionic) | 10–25 |
| Adjuvants | 0.1–5 |
| Water | Balance |

Other conventional cleaner/degreaser emulsion compositions are typically water-in-oil or oil-in-water emulsions in which the organic solvent is substantially water insoluble. Such emulsions can contain insoluble materials such as toluene, orthodichlorobenzene or mixtures thereof with emulsifier compositions. Other available emulsions can comprise xylene, kerosene, mineral spirits, benzene, naphthalene, sulfonates, emulsified with various surfactants to form dispersions in aqueous media. Illustrative such available compositions are marketed under the tradenames: Brulin 512®, Spartan WRD-60®, Betco Emulsifiable Solvent Degreaser®, Amrepjel-sol® and Boisactusol®. These emulsions are inherently water insoluble organic solvents, typically a hydrocarbon solvent emulsified with a surfactant coupler in the solvent component. In large part, the prior art is typically non-aqueous or uses an aqueous medium as a carrier for the active ingredients. The prior art does not recognize that water can be an active and an important ingredient in the compositions that can cooperate with the other components in achieving increased activity.

Conventional stripper formulations are water-soluble concentrates with a composition typically comprised of primarily water soluble glycol ether solvent, alkanolamine, alkali, surfactant, and water.

TABLE 2

Conventional Solvent Stripper Formula

| Ingredient | Wt % |
|---|---|
| Water-soluble glycol ether | 10–40 |
| Alkali or Alkanolamine | 1–40 |
| Thickener | 0–5 |
| Surfactant (anionic/nonionic) | 1–20 |
| Adjuvants | 0.1–5 |
| Water | Balance |

Even in view of the large body of prior art relating to cleaner/degreaser and stripper compositions, a substantial need exists for materials that are active in removing hard floor finishes and crosslinked finishes, photo-resist materials and contaminating polymeric material from fabrics and other substrates. A substantial need exists for low cost, highly active, easily formulated soil and polymer film removing compositions.

SUMMARY OF THE INVENTION

We have surprisingly found that blends of certain substantially water-insoluble ether alcohol solvent materials with a solvent coupler results in a concentrate that can be mixed with water to make an improved dispersion useful in soil removal. The ether alcohol, having relatively low water solubility and relatively low volatility, in an aqueous medium exhibits surprisingly enhanced soil or film removing properties when combined with the solvent coupler. This is particularly surprising in that the system is most effective when the solvent coupler level is such that it is insufficient to solubilize the water-insoluble ether alcohol solvent into aqueous solution, forming a composition in the form of a dispersion. We have found that the nature of the material when diluted in water must be a dispersion of the material in the aqueous medium. The solubility of the total organic part must be such that at least some of the organic part forms a dispersion, not a solution, of the organic material in water. We have found that the primary solvent ether alcohol material of the invention has a water solubility less than 5%, preferably less than 3%, most preferably less than 2% in water. The solvents and solvent coupler compositions of the invention are also of reduced volatility. The vapor pressure of the neat liquids is independently less than 1 mm-Hg, preferably less than 0.8 mm-Hg, with a flash point of greater than 90° C., preferably greater than 100° C.

The preferred primary solvent in the invention comprises a phenyl ether typically an ethylene glycol phenyl ether or propylene glycol phenyl ether. The primary solvent typically has a water solubility substantially less than the first solvent/coupler material. The combined material forms the organic phase of the dispersion. A preferred blend of organic materials can be used in forming the dispersions of the invention in which a primary solvent is combined with a first solvent/coupler and a second solvent/coupler. The water solubility of these materials in order are as follows. The solubility of the first solvent/coupler is greater than the water solubility of the second solvent coupler and the solubility of the second solvent/coupler is greater than the solubility of the primary solvent material. The following table sets forth the solubilities of the useful materials in the organic phase of the dispersions.

TABLE 3

Water Solubility of Components

| Composition Component | Preferred (wt.-%) | More Preferred (wt.-%) | Most Preferred (wt.-%) |
|---|---|---|---|
| Solvent/Coupler 1 | 20–100 | 50–100 | 80–100 |
| Solvent/Coupler 2 | 1–80 | 1–30 | 1–15 |
| Primary Solvent | <5 | <3 | <2 |

An amount of the combined primary solvent and solvent/coupler materials is used such that the amount of organic materials added to the aqueous system is greater than the solubility of the materials in the aqueous system. In other words, by example, if a combined solvent, solvent/coupler material is added to an aqueous medium in an amount of about 10 wt % or more of the aqueous medium, the solubility of the organic phase is less than 10 wt %, preferably less than 2 wt %.

We have found a preferred primary solvent system. The solvent materials comprise an ethylene glycol or propylene glycol phenyl ether solvent composition of the formula:

$$HO—R_1—O—PH$$

wherein $R_1$ is a $C_{2-3}$ alkylene group and PH represents an aromatic ring such as phenyl, substituted phenyl, naphthyl, etc. This primary solvent can be made to cooperate with an ether alcohol coupler/solvent composition and in an aqueous medium to form a highly effective stripper cleaner composition in the form of an aqueous dispersion. We have found that these materials, at the right concentrations, cooperate to obtain polymer removal of difficult to remove materials such as highly crosslinked hard urethane and acrylic floor finishes. Such films were previously resistant to solvent-based removal methods. We have found that water is an essential ingredient and serves to activate the alkylene glycol phenyl ether mixture with the alcohol ether coupler solvent. We have also found that the selection of the amounts of the alkylene glycol phenyl ether, the ether alcohol coupler/cosolvent, the relative proportions of the solvent and the coupler and the nature of the composition comprising the coupler/solvent in an aqueous dispersion is important. The dilute materials have optimum activity when dispersed in an aqueous medium and are visibly hazy, cloudy or opaque. The solubility of the combined solvent and solvent/coupler composition is above combined solubility limits. The aqueous materials of the invention comprise an ethylene glycol or propylene glycol phenyl ether solvent composition combined with an ether alcohol coupler/solvent composition, with the phenyl ether solvent having the following structure:

$$HO—R_1—O—PH$$

wherein $R_1$ is a $C_{2-3}$ alkylene group and PH represents an aromatic ring such as phenyl. The preferred phenyl ether primary solvents have a water solubility of about 1 wt %.

We have also found a preferred ether alcohol coupler solvent that comprises a blend of a first alcohol ether coupler/solvent having the formula:

$$R_2—O—(R_3O)_mH$$

wherein $R_2$ is a $C_{2-10}$ linear or branched alkyl, preferably a $C_{2-5}$ alkyl, $R_3$ comprises a $C_{2-10}$ alkylene, preferably a $C_{2-3}$ alkylene and m is 1 to 6, preferably 1 or 2. Preferably, $R_2$ comprises ethyl, propyl, isopropyl, butyl or t-butyl and $R_3$ comprises ethylene or propylene and a second alcohol ether coupler/solvent having the formula:

$$R_4—O—(R_5O)_mH$$

$R_4$ is $C_{2-10}$ linear or branched alkyl, $R_5$ comprises a $C_{2-10}$ alkylene and m is 1 to 6. Preferably, the ether alcohol coupler/solvent comprises:

$$R_4—O—(R_5O)_mH$$

wherein $R_4$ comprises a $C_{2-10}$ linear or branched alkyl group, $R_5$ comprises an ethylene, or propylene moiety, m is a number from 1 to 3. The solubility of the combination of the primary solvent with either the single part solvent coupler or the two part solvent coupler is less than about 5 grams of solvent per 100 grams of water. Other preferred blends of primary solvent and solvent/couplers have a flash point greater than about 90° C., typically greater than about 100° C. The vapor pressure of the preferred materials is less than about 0.1 millimeter of mercury, typically less than about 0.08 millimeter of mercury (mm-Hg).

We believe that the solvent material comprising an alkylene glycol phenyl ether is a primary film removing agent. The alcohol ether solvent coupler provides both removal properties and couples the alkylene glycol phenyl ether into an effective aqueous dispersion or emulsion. We have found that water is an essential component to the ingredient. Using the alkylene glycol phenyl ether and the coupler solvent at claimed proportions in an aqueous dispersion or emulsion results in an organic film removing composition that is substantially more active than the non-aqueous material or related formulations. Further, the use of a blended solvent coupler in the aqueous media still further enhance film removal properties. For the purpose of this patent application, the useful materials can be free of any one of an organic base, a nitrogen base, a solubilizing anionic surfactant additive, a fluorocarbon material, a fluorocarbon surfactant and polymeric or clay thickeners. We have found that the materials are used at a concentration that is approximately equal to or exceeds the aqueous solubility of the combined solvent and alcohol ether coupler/solvent materials combined. The resulting materials have the appearance of a hazy or cloudy liquid or an opaque white dispersion. For the purpose of this patent applications, the proportions of primary solvent to coupler solvent to water are such that a dispersion or emulsion is formed rather than a clear solution.

We have found that the stability of the dispersion and certain soil removal properties can be enhanced by the use of an effective amount of an nonionic ether surfactant material such as an EOPO block copolymer or an alcohol ethoxylate material. The materials of the invention find substantially improved soil removal properties without using aromatic solvents, chlorinated or fluorinated materials, polymeric or inorganic thickener materials and rely substantially on the solvent materials. These compositions can be removed by rinsing, vacuuming, mopping or by simply exposing the clean surface to the ambient atmosphere for drying at ambient or slightly elevated temperatures.

Further, antimicrobial agents or biocides, well-known to the art, can be incorporated into the compositions for microbial control. Biocides are antimicrobial agents or chemical compositions that can prevent microbiological contamination or deterioration caused by microorganisms. Most useful antimicrobial agents comprise phenolics, halogen compounds, quaternary ammonium compounds, amines, alkanol amines, nitro compounds and a variety of miscellaneous types of antimicrobial agents. Antimicrobial agents operate by either interfering with a cellular mechanism or a cellular component of the microbe resulting in the substantial reduction of microbial populations or simply prevent proliferation in numbers of microorganisms that would prevent the accumulation of harmful numbers of microorganisms. Antimicrobial agents are often effective against one or more of typical microbial classifications such as gram positive, gram negative, fungi, molds and yeasts. The preferred antimicrobial agent used to kill or reduce microbial populations requires physical and chemical compatibility with the system, stability and resistance to be inactivated by other components or ingredients in this system, stability under use and storage conditions of pH temperature and light exposure while being safe and essentially non-toxic to humans in handling formulation and use. Typical antimicrobial agents are used in aqueous systems solution at a concentration of about 0. 1 to 10,000 ppm. The preferred agents can include cationic species including but not limited to quaternary ammonium compounds, chlorhexidine gluconate, amine salts; phenolic derivatives such as tert-amylphenol, chlorobenzylphenol, benzylphenol, p-chloro-meta-xylenol; 5-chloro-2-(2,4-dichlorophenoxy)phenol (triclosan); hydrogen peroxide; peracids; organic peroxides; and fatty acids.

We have also found extremely effective methods for removing generic coatings from a variety of fabric or hard surfaces. We have found that even highly crosslinked urethane finishes, crosslinked and uncrosslinked acrylic finishes and other common polymeric materials are easily and rapidly removed using the compositions of the invention.

DETAILED DESCRIPTION OF THE INVENTION

The invention relies in compositions and methods of using the compositions in removing organic films and soils.

In one aspect of the invention, the invention resides in a concentrate material that comprises a blend of the solvent and ether alcohol solvent couplers in the substantial absence of water. Such concentrate materials can be used in inventive methods in which the concentrates are combined with water to form an active dispersion or emulsion. These dispersions or emulsions can be used in methods of removing the organic films or soils. Further, the invention resides in aqueous use solutions comprising the solvent combined with the ether alcohol solvents of the invention to form a highly effective composition that can be used to remove organic soils or films. Such materials are also applicable in inventive methods disclosed in the application.

The primary solvent material used in the compositions of the invention comprise the composition of the formula:

$$HO—R_1—O—PH$$

wherein $R_1$ comprises a $C_{2-3}$ alkylene group and PH represents an aromatic monocyclic ring, the solvent having a solubility of less than 5 grams of solvent per 100 grams of water or aqueous medium. Preferred primary solvents for use in this invention comprise an ethylene glycol phenyl ether or a propylene glycol phenyl ether composition. While the diethylene glycol phenyl ether and the dipropylene glycol phenyl ether have some activity in this application, ethylene glycol, propylene glycol phenyl ether or mixtures thereof are preferred. Further, the use of other aromatic nuclei other than phenyl also tends to reduce activity.

We have found that the primary solvent material is coupled into the aqueous dispersion or emulsion using an ether alcohol solvent coupler composition. This coupler composition has a solubility greater than the solubility of the primary solvent, and is substantially soluble in water or the aqueous medium. We believe that the solubility limitations are important indicia of active solvent materials. The ether alcohol solvent coupler comprises a compound of the formula:

$$R_2—O—(R_3O)_mH$$

wherein $R_2$ comprises a $C_{2-10}$ linear or branched alkyl group and $R_3$ comprises a $C_{2-10}$ alkylene group and m is a number of 1 to 6.

A preferred solvent coupler comprises a blend of a first solvent coupler comprising the formula:

$$R_2—O—(R_3O)_m—OH$$

wherein $R_2$ is a $C_{2-4}$ alkyl, $R_3$ is ethylene or propylene and m is 1 or 2. A second solvent coupler comprises the formula:

$$R_4—O—(R_5O)_n—OH$$

wherein $R_4$ comprises a $C_{2-4}$ alkyl group, $R_5$ comprises ethylene or propylene and n is 1 or 2. These solvent/coupler materials have a water solubility greater than the primary solvent.

Formulations useful in the invention can be exemplified by the following formulation tables:

TABLE 4

Use Dispersion or Emulsion

| Component | Useful (Wt %) | Preferred (Wt %) | Most Preferred (Wt %) |
|---|---|---|---|
| Primary Solvent | 0.1–70 | 0.3–30 | 0.4–15 |
| Solvent/Coupler | 0.1–70 | 0.3–30 | 0.4–15 |
| Second Solvent/Coupler | 0–70 | 0.3–30 | 0.4–15 |
| Water | Bal. | Bal. | Bal. |

TABLE 5

Concentrate

| Component | Useful (Wt %) | Preferred (Wt %) | Most Preferred (Wt %) |
|---|---|---|---|
| Primary Solvent | 15–75 | 20–45 | 25–40 |
| Solvent/Coupler | 15–75 | 20–45 | 25–40 |
| Second Solvent/Coupler | 15–75 | 20–45 | 25–40 |

TABLE 6

Preferred Use Dispersion or Emulsion

| Component | Useful (Wt %) | Preferred (Wt %) | Most Preferred (Wt %) |
|---|---|---|---|
| Alkylene glycol phenyl ether | 0.1–70 | 0.3–30 | 0.4–15 |
| Alkylene glycol alkyl ether | 0.1–70 | 0.3–30 | 0.4–15 |
| Alkylene glycol alkyl ether | 0.1–70 | 0.3–30 | 0.4–15 |
| (EO) or (PO) or (EO)(PO) surfactant | 0–25 | 0–10 | 0.1–5 |
| Water | Bal. | Bal. | Bal. |

TABLE 7

Preferred Concentrate

| Component | Useful (Wt %) | Preferred (Wt %) | Most Preferred (Wt %) |
|---|---|---|---|
| Ethylene glycol phenyl ether | 15–75 | 20–45 | 25–40 |
| Alkylene glycol alkyl ether | 15–50 | 20–45 | 25–40 |
| Alkylene glycol alkyl ether | 15–30 | 20–45 | 25–40 |
| (EO) or (PO) or (EO)(PO) surfactant | 0–25 | 0–15 | 0.1–12 |

The improved cleaning efficiency of the compositions of the invention rely on the use of a primary solvent comprising 2-phenoxy propanol or 2-phenoxy ethanol. This water-insoluble aromatic ether solvent appears to be an excellent solvent cleaner material. The aromatic ether solvent material of the invention requires an ether alcohol coupler material having aqueous solubility greater than the aromatic ether solvent that provides solvent properties that enhance the film removing properties of the invention, but also aid in coupling the aromatic ether alcohol solvent into aqueous dispersion.

Examples of lower alkyl ethers of ethylene or propylene glycol useful in this invention include ethylene glycol ethyl ether, propylene glycol ethyl ether, propylene glycol propyl ether, propylene glycol isopropyl ether, propylene glycol butyl ether, propylene glycol isobutyl ether, propylene glycol tertiary butyl ether. The preferred solvent/coupler comprises ethylene or propylene glycol butyl ether. Further, the stability and activity of the compositions of the invention can be enhanced by the presence of a second solvent/coupler material. Examples of the second solvent/coupler material of the invention include diethylene glycol butyl ether, propylene glycol methyl ether, dipropylene glycol ethyl ether, dipropylene glycol propyl ether, dipropylene glycol isopropyl ether, dipropylene glycol butyl ether, dipropylene glycol isobutyl ether, tripropylene glycol methyl ether, tripropylene glycol ethyl ether, tripropylene glycol propyl ether, tripropylene glycol isopropyl ether, tripropylene glycol butyl ether and tripropylene glycol isobutyl ether.

The cleaning capacity, product uniformity and other utility of the compositions of the invention can be improved by the presence of a surfactant material. Preferably the surfactant is nonionic in nature. Preferred nonionic surfactants for use in the invention can include any nonionic surfactant having a region of relative hydrophobicity and a region of hydrophilicity. Typically, regions of hydrophilicity comprise a polymeric block of ethylene oxide, typically greater than 3 moles of ethylene oxide, preferably 5 to 20 moles of ethylene oxide. The regions of relative hydrophobicity can be manufactured from linear alcohols, alkyl phenyl groups, blocks of polymerized propylene oxide or other relatively hydrophobic compositions. Preferred nonionic surfactants for use in this invention include alcohol ethoxylates and surfactant compositions comprising at least an ethylene oxide block $(EO)_x$ and a propylene oxide block $(PO)_y$ wherein EO represents ethylene oxide and PO represents propylene oxide while x represents 3 to 16 and y represents 3 to 16. Most preferred surfactants of the invention comprise alcohol ethoxylates made by reacting an alcohol or alkylphenol or sodium alkoxylate salts thereof with 3 to 16 moles of ethylene oxide to form the alcohol ethoxylate surfactant. Preferred alcohols for use in the invention are typical fatty alcohols having linear fatty groups with 9 to 24 carbon atoms, preferably 9 to 16 carbon atoms. The aqueous concentrates and dispersions of the organic phase in the aqueous media can also contain the presence of additive materials. Such additives include dyes, perfumes, alkalinity sources such as ammonia, alkanol amines, caustic materials, fluorescing agents, biocidal agents, etc.

The following examples and data provide further illustration of compositions and methods actually performed. The Examples and Tables of data disclose illustrative examples and include a best mode.

EXAMPLE 1

Into a conventional laboratory container and stirrer was charged 30 parts by weight of propylene glycol phenyl ether. Next into the container was charged 30 parts by weight of ethylene glycol n-butyl ether followed by 30 parts by weight of dipropylene glycol n-butyl ether. The materials were blended until uniform and into the blended mixture was placed 10 parts by weight of a $C_{12-14}$ linear alcohol (9 mole) ethoxylate surfactant material. The material was blended until uniform.

EXAMPLE 2

10 parts by weight of the blended material of Example 1 were combined with 90 parts by weight of deionized water. The resulting cloudy dispersion was agitated until uniform forming a cloudy dispersion of the organic materials in the aqueous medium.

EXAMPLE 3

Example 1 was repeated except the linear alcohol ethoxylate material was omitted.

EXAMPLE 4

Example 1 was repeated except that an ethylene glycol phenyl ether was used in place of the propylene glycol phenyl ether.

EXAMPLE 5

Example 3 was repeated except that an ethylene glycol phenyl ether was used in place of the propylene glycol phenyl ether.

The aqueous organic compositions of the invention were used in experiments to demonstrate the efficacy of the materials in removing even very stubborn floor finishes. Urethane and acrylic floor finishes were used as models because these materials are hard and difficult to remove. The floor finishes are equal to or more difficult to remove than other common targets of this technology. Additionally, the aqueous organic compositions of the invention were used to clean photoresist soiled GORTEX™ (expanded polytetrafluoroethylene) clean room garments. These garments were made from a PTFE having a micropore structure for breathability but resulting in soil retention. Other high tech fibers can also be used including Kevlar®, nylon, polypropylene, etc. The formula of Example 1 was added to water at 120° F. to result in a 5% dispersion of the formula in water. The garments were washed for 30 minutes, rinsed twice, and dry cleaned. The resulting product substantially free of photoresist as a result of the aqueous cleaning step. Samples dry cleaned without the treatment with compositions of the invention were not substantially cleaned of photoresist residue.

The urethane floor finishes used in the invention testing are:

TABLE 8

Conventional Urethane Floor Finish

| Component | Wt.-% |
|---|---|
| Polyurethane Dispersion | 90 |
| Glycol ether solvent | 2 |
| Nonionic surfactant | 0.2 |
| Fluorinated Surfactant | less than 0.1 |
| Silicone defoamer | less than 0.1 |
| Water | q.s. |

The acrylic floor finishes used in the invention testing are:

TABLE 9

Conventional Acrylic Floor Finish

| Component | Wt.-% |
|---|---|
| Polyacrylic emulsion | 39 |
| Wax emulsion | 6 |
| Glycol ether solvent | 6 |
| Resin solution | 3 |
| Plasticizer blend | 3 |
| Preservative | 0.1 |
| Surfactant/defoamer blend | less than 0.2 |
| Water | q.s. |

The aqueous organic materials of the invention were compared to conventional organic or "stripper" materials used in floor finish removal. The conventional material comprises:

TABLE 10

| Conventional Stripper | |
|---|---|
| Component | Wt.-% |
| Monoethanol amine | 25 |
| Water-soluble alkyl glycol ether solvent | 25 |
| Nonionic surfactant | 3 |
| Chelator | 0.4 |
| Water | q.s. |

The diluted composition of this invention was compared with prior art film removers and the undiluted concentrate material of this invention in removing acrylic finishes, urethane finishes and crosslinked finishes. The following data support the finding that the aqueous dispersions of this invention are significantly superior to prior art materials and to the undiluted non-aqueous material concentrate of the invention.

TABLE 11

Comparison of New Stripper Technology with Conventional Stripper

| | Acrylic Finish | | Urethane Finish | |
|---|---|---|---|---|
| | Un-crosslinked | Aziridine Crosslinked | Un-crosslinked | Aziridine Crosslinked |
| Comp. Table 8 Prior Art Mat. (undiluted) | 2 | 2 | 2 | 2 |
| Invention Example 1 | 1 | 1 | 1 | 0 |
| Invention Example 2 | 2 | 2 | 2 | 1 |
| Comp Table 8 at 10% | 2 | 1 | 1 | 0 |

0 = no removal, 1 = partial removal 2 = full removal-Stripping Procedure: Keep floor wet with stripper for 10 minutes; agitate with stripping pad; cold water rinse.

TABLE 12

Stripper Comparison on Acrylic/Urethane Tile Cured 2 Weeks at 120° F.

| | | Removability | | |
|---|---|---|---|---|
| Urethane | Acrylic | Comp. Table 8 (Aq Dil. @ 12.5 wt %) | Example 2 | Example 1 at 5 Wt.-% Dilution |
| 0 | 100 | 2 | 2 | 2 |
| 10 | 90 | 2 | 2 | 2 |
| 30 | 70 | 1 | 2 | 2 |
| 50 | 50 | NA | 2 | 2 |
| 70 | 30 | NA | 2 | 2 |
| 100 | 0 | 0 | 2 | 2 |

In the numerical results, 2 indicates complete removal, 1 indicates partial removal and 0 indicates no removal. NA indicates that the stripper samples ran together on tile.

Experiments to better define component ratios for the composition in the invention were completed. Based on the data below, the ratio of water to total other components should be about 1:9–9:0.5, respectively, with 1:3–3:1 preferred.

The preferred systems seems to perform best when the dispersion in aqueous media is not clear. This is in contrast to Van Eenam U.S. Pat. No. 5,080,831, that call for a clear mixture for best performance.

EXAMPLE 7

Water activation of the invention was demonstrated by first preparing a formulation like Example 1, shown in Table 13.

TABLE 13

| Composition | | |
|---|---|---|
| Ingredient | Amount (wt.-%) | Function |
| Laureth/myristeth-(9 mole EO) | 10% | Nonionic Surfactant |
| Diethylene glycol butyl ether | 30% | Primary Solvent |
| Dipropylene glycol butyl ether | 30% | Solvent/Coupler |
| Propylene glycol phenyl ether | 30% | Solvent/Coupler |

This composition was then mixed in various ratios with water and used to strip an aziridine-crosslinked polyurethane coating from a floor tile, giving the results noted in the table below:

TABLE 14

Finish Removal Properties

| Water wt % | Composition of Example 7-wt % | Degree of finish removal | Appearance of the aqueous mixture |
|---|---|---|---|
| 0 | 100 | None | clear |
| 90 | 10 | Partial | opaque |
| 50 | 50 | complete | cloudy |
| 25 | 75 | partial | clear |
| 10 | 90 | Minimal | clear |
| 100 | 0 | None | clear |

Prior art materials such as those shown in the Van Eenam patents disclosed above use the propylene glycol phenyl ether (Dowanol PPh) material in formulations with a variety of materials in the formulations. Van Eenam uses inorganic bases, anionic surfactants, nitrogen surfactants, bases and other nitrogen compounds to form generally clear single phase materials.

We have prepared representative formulations from Van Eenam U.S. Pat. No. 5,080,831 and Van Eenam PCT WO 91/09104.

TABLE 15A

Comparative Van Eenam Formulas A and B

| Formula A: | Component | Amount |
|---|---|---|
| Clear single phase with bluish tint | Propylene glycol phenyl ether | 10.0 g |
| | Monamide 150 IS (Fattyamide nonioinic surf.) | 1.5 g |
| | Deionized water | 88.5 g |

TABLE 15B

| Formula B | Component | Amount |
|---|---|---|
| Clear Solution | Propylene glycol phenyl ether | 4.0 g |
| | Linear Alkane Sulfonic acid | 0.6 g |
| | 50% aqueous NaOH | 0.15 g |
| | $Na_4$-EDTA | 0.3 g |
| | Deionized. Water | 94.95 g |

Formulae A and B were diluted at 10 wt % in an aqueous solution. The dilutions were still clear, but provided minimal finish removal on tile coated with the aziridine crosslinked urethane shown above.

The above specification, examples and tables of data serve to illustrate aspects of the invention developed to date. However, the invention can comprise many variations of the components of the invention without departing from the spirit or scope of the invention. Accordingly, the invention resides in the claims hereinafter appended.

We claim:

1. A solvent concentrate comprising:

(a) about 1 to 75 wt % of an ether alcohol solvent having a solubility in water of less than about 5 wt % of the solvent; and (b) about 1 to 75 wt % of a first ether alcohol solvent/coupler, said solvent/coupler present in an amount that said solvent concentrate forms a dispersion when added to water, said first solvent/coupler having a water solubility greater than the ether alcohol solvent, said first solvent/coupler comprising the formula:

$$R_2—O—(R_3O)_m—H$$

wherein $R_2$ comprises a $C_2$–$C_{10}$ linear or branched alkyl group and $R_3$ comprises a $C_2$–$C_{10}$ alkylene group and m is a number from 1 to 6, wherein said first solvent/coupler has a solubility in water of about 20 to about 100 wt % of the first solvent coupler;

wherein the vapor pressure of the concentrate is less than 1 mm-Hg.

2. The concentrate of claim 1 wherein the concentrate also comprises about 0.1 to 30 wt % of an antimicrobial agent.

3. The concentrate of claim 1 further comprising a second solvent/coupler, wherein the second solvent coupler has a water solubility of about 1 to 80 wt % but less than that of the first solvent/coupler, and greater than that of the ether alcohol solvent.

4. The composition of claim 3 wherein the second solvent/coupler comprises an ether alcohol solvent/coupler.

5. The concentrate of claim 1 wherein the solubility of the concentrate in water is about 2 wt % or less.

6. The concentrate of claim 1 wherein the concentrate additionally comprises about 0.1 to about 30 wt % of a surfactant composition.

7. The concentrate of claim 1 wherein the ether alcohol solvent comprises the formula:

$$HO—R_1—O—PH$$

wherein $R_1$ comprises a $C_{2-3}$ alkylene group and PH represents an aromatic monocyclic ring, the solvent composition having a solubility of less than 5 grams of solvent per 100 grams of water.

8. The concentrate of claim 1, wherein $R_2$ comprises a $C_2$–$C_4$ linear or branched alkyl group, $R_3$ comprises ethylene or propylene and m is 1 or 2.

9. The concentrate of claim 1 further comprising an effective amount of a second solvent/coupler, said second solvent/coupler having a water solubility less than the first solvent/coupler, said second solvent/coupler comprising the formula:

$$R_4—O—(R_5O)_m—H$$

wherein $R_4$ comprises a $C_2$–$C_{10}$ linear or branched alkyl group and $R_5$ comprises a $C_2$–$C_{10}$ alkylene group and m is a number from 1 to 6, the second solvent/coupler having a solubility of about 1 to 80 grams of solvent per 100 grams of water but less than that of the first solvent/coupler, and greater than that of the ether alcohol solvent.

10. A method of forming an aqueous cleaning composition by activating the concentrate composition of claim 1 in aqueous composition, the method comprises combining about 0.01 to about 50 parts of the composition of claim 1 with 50 to 99.99 parts of an aqueous medium forming an active aqueous cleaning composition wherein the cleaning composition has a cleaning capacity greater than that of the concentrate.

11. The method of claim 10 additionally comprising the step of combining the aqueous cleaning solution with a soiled substrate.

12. The composition of claim 9 wherein m is a number of 1 to 2.

13. The composition of claim 9 wherein $R_4$ is $C_2$–$C_4$, and $R_5$ is ethylene or propylene.

14. The composition of claim 1 wherein the ether alcohol solvent comprises ethylene glycol phenyl ether, propylene glycol phenyl ether or mixtures thereof.

15. An aqueous solvent based dispersion capable of removing an organic layer or soil from a substrate, the composition comprising:

(a) a major proportion of an aqueous phase;

(b) an effective amount up to about 70 wt % of an ether alcohol solvent comprising the formula:

$$HO—R_1—O—PH$$

wherein $R_1$ comprises a $C_2$–$C_3$ alkylene group, and PH comprises an aromatic ring, wherein the ether alcohol solvent has a water solubility of less than 5 wt %; and (c) an effective amount up to about 70 wt % of a first ether alcohol solvent/coupler, said first solvent/coupler having a water solubility greater than the ether alcohol solvent, said first solvent/coupler comprising the formula:

$$R_2—O—(R_3O)_m—H$$

wherein $R_2$ comprises a $C_2$–$C_{10}$ linear or branched alkyl group and $R_3$ comprises a $C_2$–$C_{10}$ alkylene group and in is a number from 1 to 6, wherein the first solvent/coupler has a solubility in water of about 20 to 100 wt %;

wherein the vapor pressure of the organic phase is less than about 1 mm-Hg and the organic phase comprising the solvent and the first solvent/coupler cooperate to form an aqueous dispersion containing an amount of a solvent in a first solvent/coupler greater than the solubility of the organic phase in the aqueous medium.

16. The composition of claim 15 further comprising an effective amount of a second solvent/coupler up to about 30 wt % of a second ether alcohol solvent/coupler comprising the formula:

$$R_4—O—(R_5O)_m—H$$

wherein $R_4$ comprises a $C_2$–$C_{10}$ linear or branched all group and $R_5$ comprises a $C_2$–$C_{10}$ alkylene group and m is a number from 1 to 6, the solvent having a solubility of about 1 to 80 grams of solvent per 100 grams of water.

17. The aqueous composition of claim 15 additionally comprising about 0.1 to 30 wt % of an antimicrobial agent.

18. The composition of claim 15 wherein the solubility of the organic phase comprising the ether alcohol solvent and any ether alcohol solvent/coupler, is about 2 wt % or less in the aqueous medium.

19. The composition of claim 15 wherein the ether alcohol solvent comprises ethylene glycol phenyl ether, propylene glycol phenyl ether or mixtures thereof.

20. A method of cleaning a substrate using the aqueous organic dispersion of claim 15, the method comprising contacting a substrate having a soil with an effective amount of the aqueous organic dispersion of claim 15, and removing the soil from the substrate.

21. The method of claim 20 wherein the substrate comprises a hard surface.

22. The method of claim 21 wherein the hard surface comprises a floor surface.

23. The method of claim 21 wherein the soil comprises a floor finish.

24. The method of claim 20 wherein the soil comprises paint, ink, photoresist, an organic polymeric composition, a food soil or mixtures thereof.

25. The method of claim 20 wherein the substrate comprises a porous substrate.

26. The method of claim 25 wherein the porous substrate comprises a woven fabric or a non-woven fabric.

27. The method of claim 25 wherein the porous substrate comprises a porous PTFE fabric.

28. The method of claim 25 wherein the soil comprises a polymeric composition, a paint, an ink, a photoresist, a food soil or mixtures thereof.

29. The method of claim 20 wherein the composition contains an effective amount of a second solvent/coupler up to about 30 wt % of a second ether alcohol solvent/coupler comprising the formula:

$$R_4—O—(R_5O)_m—H$$

wherein $R_4$ comprises a $C_2$–C10 linear or branched alkyl group and $R_5$ comprises a $C_2$–$C_{10}$ alkylene group and m is a number from 1 to 6, the solvent having a solubility of about 1 to 80 grams of solvent per 100 grams of water, but less than that of the first solvent/coupler, and greater than that of the ether alcohol solvent.

30. The method of claim 20 additionally comprising about 0.1 to 30 wt % of an antimicrobial agent.

31. The method of claim 20 wherein the solubility of the organic phase comprising the ether alcohol solvent and any ether alcohol solvent/coupler, is about 2 wt % or less in the aqueous medium.

32. A solvent concentrate comprising:

(a) about 15 to 75 wt % of an ether alcohol solvent, said solvent comprising the formula:

$$HO—R_1—O—PH$$

wherein $R_1$ comprises a $C_2$–$C_{10}$ linear or branched alkyl group, PH comprises an aromatic ring, wherein the ether alcohol solvent has a solubility in water of less than about 5 wt % of the solvent; and (b) about 15 to 75 wt % of a first ether alcohol solvent/coupler, said solvent/coupler present in an amount that said solvent concentrate forms a dispersion when added to water, said first solvent/coupler having a water solubility greater than the ether alcohol solvent, said first solvent/coupler comprising the formula:

$$R_2—O—(R_3O)_m—H$$

wherein $R_2$ comprises a $C_2$–$C_{10}$ linear or branched alkyl group and $R_3$ comprises a $C_2$–$C_{10}$ alkylene group and m is a number from 1 to 6, wherein said first solvent/coupler has a solubility in water of about 20 to about 100 wt % of the solvent coupler;

wherein the concentrate is substantially free of a nitrogen base and the vapor pressure of the concentrate is less than 1 mm-Hg.

33. A solvent concentrate comprising:

(a) about 15 to 75 wt % of an ether alcohol solvent comprising the formula:

$$HO—R_1—O—PH$$

wherein $R_1$ comprises a $C_2$–$C_{10}$ linear or branched alkyl group, and PH is an aromatic group, wherein said ether alcohol solvent has a solubility in water of less than about 5 wt % of the solvent; and (b) about 15 to 75 wt % of a first ether alcohol solvent/coupler, said solvent/coupler present in an amount that said solvent concentrate forms a dispersion when added to water, said first solvent/coupler having a water solubility greater than the ether alcohol solvent, said first solvent/coupler comprising the formula:

$$R_2—O—(R_3O)_m—H$$

wherein $R_2$ comprises a $C_2$–$C_{10}$ linear or branched alkyl group and $R_3$ comprises a $C_2$–$C_{10}$ alkylene group and m is a number from 1 to 6 having a solubility in water o about 100 wt % of the solvent coupler;

wherein the vapor pressure of the concentrate is less than 1 mm-Hg.

34. A solvent concentrate comprising:

(a) about 1 to 75 wt % of a first propylene glycol or dipropylene glycol phenyl ether alcohol solvent having solubility in water of less than about 5 wt % of the solvent;

(b) about 1 to 75 wt % of a second propylene glycol or dipropylene glycol ether alcohol solvent/coupler having a solubility in water of about 20 to about 100 wt % of the solvent coupler, said solvent/coupler present in an amount that said solvent concentrate forms a dispersion when added to water;

wherein the vapor pressure of the concentrate is less than 1 mm-Hg.

35. A method of forming an aqueous cleaning composition by activating the concentrate composition of claim 1 in aqueous composition, the method comprises combining about 0.01 to about 50 parts of the composition of claim 1 with 50 to 99.99 parts of an aqueous medium forming an active aqueous cleaning composition wherein the cleaning composition is substantially free of a nitrogen base and has a cleaning capacity greater than that of the concentrate.

36. The solvent concentrate of claim 1, having about 20 to 45 wt % of said ether alcohol solvent and about 20 to 45 wt % of said first ether alcohol solvent/coupler.

37. The method of claim 20, wherein the soil comprises protein and cellulosics polymeric films.

38. The method of claim 20, wherein the soil comprises oxidized or polymerized food soils.

39. A method of removing protein and cellulosics polymeric film soils from a soiled substrate comprising:

contacting the soiled substrate with:

an aqueous solvent based dispersion, the composition comprising:

(a) a major proportion of an aqueous phase;

(b) an effective amount up to about 70 wt % of an ether alcohol solvent comprising the formula:

$$HO—R_1—O—PH$$

wherein $R_1$ comprises a $C_2$–$C_3$ alkylene group, and PH comprises an aromatic ring, wherein the ether alcohol an solvent has a water solubility of less than 5 wt %; and (c) an effective amount up to about 70 wt % of a first ether alcohol solvent/coupler, said first solvent/coupler having a water solubility greater than the ether alcohol solvent, said first solvent/coupler comprising the formula:

$$R_2—O—(R_3O)_m—H$$

wherein $R_2$ comprises a $C_2$–$C_{10}$ linear or branched alkyl group and $R_3$ comprises a $C_2$–$C_{10}$ alkylene group and m is a number from 1 to 6, wherein the first solvent/coupler has a solubility in water of about 20 to 100 wt %;

wherein the vapor pressure of the organic phase is less than about 1 mm-Hg and the organic phase comprising the solvent and the first solvent/coupler cooperate to form an aqueous dispersion containing an amount of a solvent in a first solvent/coupler greater than the solubility of the organic phase in the aqueous medium; and removing the protein and cellulosics polymeric film soils from the soiled substrate.

40. A method of removing oxidized or polymerized food soils from a soiled substrate comprising:

contacting the soiled substrate with:

an aqueous solvent based dispersion, the composition comprising:

(a) a major proportion of an aqueous phase;

(b) an effective amount up to about 70 wt % of an ether alcohol solvent comprising the formula:

$$HO—R_1—O—PH$$

wherein $R_1$ comprises a $C_2$–$C_3$ alkylene group, and PH comprises an aromatic ring, wherein the ether alcohol solvent has a water solubility of less than 5 wt %; and (c) an effective amount up to about 70 wt % of a first ether alcohol solvent/coupler, said first solvent/coupler having a water solubility greater than the ether alcohol solvent, said first solvent/coupler comprising the formula:

$$R_2—O—(R_3O)_m—H$$

wherein $R_2$ comprises a $C_2$–$C_{10}$ linear or branched alkyl group and $R_3$ comprises a $C_2$–$C_{10}$ alkylene group and m is a number from 1 to 6, wherein the first solvent/coupler has a solubility in water of about 20 to 100 wt %;

wherein the vapor pressure of the organic phase is less than about 1 mm-Hg and the organic phase comprising the solvent and the first solvent/coupler cooperate to form an aqueous dispersion containing an amount of a solvent in a first solvent/coupler greater than the solubility of the organic phase in the aqueous medium; and removing the oxidized or polymerized food soils from the soiled substrate.

* * * * *